US009899174B2

(12) United States Patent
Zhang et al.

(10) Patent No.: US 9,899,174 B2
(45) Date of Patent: Feb. 20, 2018

(54) BIPOLAR MAGNETIC LATCHING RELAY

(71) Applicant: ZHEJIANG CHINT ELECTRICS CO., LTD., Zhejiang (CN)

(72) Inventors: Minghui Zhang, Zhejiang (CN); Zhenxiang Liu, Zhejiang (CN); Tifeng Xiao, Zhejiang (CN)

(73) Assignee: CHINT ELECTRONICS CO., LTD. (CN)

( * ) Notice: Subject to any disclaimer, the term of this patent is extended or adjusted under 35 U.S.C. 154(b) by 0 days.

(21) Appl. No.: 15/036,665

(22) PCT Filed: Nov. 29, 2013

(86) PCT No.: PCT/CN2013/088158

§ 371 (c)(1),
(2) Date: May 13, 2016

(87) PCT Pub. No.: WO2015/070490

PCT Pub. Date: May 21, 2015

(65) Prior Publication Data

US 2016/0284498 A1 Sep. 29, 2016

(30) Foreign Application Priority Data

Nov. 15, 2013 (CN) ..... 2013 1 0572264

(51) Int. Cl.
*H01H 51/22* (2006.01)
*H01H 50/58* (2006.01)

(52) U.S. Cl.
CPC ..... *H01H 51/2263* (2013.01); *H01H 50/58* (2013.01)

(58) Field of Classification Search
CPC ..... H01H 51/2263; H01H 50/58
(Continued)

(56) References Cited

U.S. PATENT DOCUMENTS 6,320,485 B1 * 11/2001 Gruner ..... H01H 50/546 335/132
7,659,800 B2 * 2/2010 Gruner ..... H01H 1/26 335/185

(Continued)

FOREIGN PATENT DOCUMENTS

CN 200950426 9/2007
CN 101552521 10/2009

(Continued)

OTHER PUBLICATIONS

International Search Report dated Aug. 4 2014 issued in corresponding International patent application No. PCT/CN2013/088158.
Chinese Search Report dated Jan. 26, 2015 issued in corresponding Chinese application No. 201310572264X.

*Primary Examiner* — Bernard Rojas
(74) *Attorney, Agent, or Firm* — Ostrolenk Faber LLP

(57) ABSTRACT

The bipolar magnetic latching relay comprises a coil assembly, a magnetic steel assembly that contains a permanent magnet and armatures, as well as two contact devices that are mounted at both sides of a base, wherein the magnetic steel assembly is pivotally connected with the base through a revolving pair, the magnetic steel assembly swings between two positions under the driving of an electric signal of the coil assembly and is retained in one swing position due to the permanent magnetic force of the magnetic steel assembly, and the swing synchronously drives the two contact devices to deflect, such that two pairs of first movable contacts and static contacts are subjected to closing/disconnecting fit. The magnetic steel assembly is provided with two driving heads that synchronously rotate along with the magnetic steel assembly and extend to the outside from the same direction. The relay further comprises two guide transmission parts that connect the two contact devices and the magnetic steel assembly, wherein a guide mechanism by which each guide transmission part moves
(Continued)

along the swing direction of the free end of the movable flat spring is provided between the guide transmission part and the base, a driven end of the guide transmission part is connected with a driving head through a driving connection structure, and a driving end of the guide transmission part is coupled to the free end of the movable flat spring through an elastic transmission structure, such that the two guide transmission parts are the same in movement direction and simultaneously act.

10 Claims, 6 Drawing Sheets

(58) Field of Classification Search
USPC ..... 335/78, 80, 131, 132
See application file for complete search history.

(56) References Cited

U.S. PATENT DOCUMENTS

| | | | | |
|---|---|---|---|---|
| 8,203,403 | B2 * | 6/2012 | Moeller | H01H 50/642 335/129 |
| 8,222,981 | B1 * | 7/2012 | Zarbock | H01H 51/2272 335/107 |
| 9,484,172 | B2 * | 11/2016 | Connell | H01H 1/54 |

FOREIGN PATENT DOCUMENTS

| | | | |
|---|---|---|---|
| CN | 202217627 | | 5/2012 |
| CN | 203607342 | | 5/2014 |
| EP | 2 009 665 | B1 | 12/2008 |
| JP | 5239420 | B2 | 7/2013 |

* cited by examiner

BIPOLAR MAGNETIC LATCHING RELAY

CROSS REFERENCE TO RELATED APPLICATIONS

The present application is a 35 U.S.C. § 371 National Phase conversion of PCT/CN2013/088158, filed Sep. 29, 2013, which claims benefit of Chinese application no. 201310572264.X, filed Nov. 15, 2013, the disclosures of which are incorporated herein by reference in their entirety. The PCT International Application was published in the Chinese language.

TECHNICAL FIELD

The present invention relates to a magnetic latching relay, in particular to a bipolar magnetic latching relay suitable for an electric card charge meter design.

BACKGROUND ART

The magnetic latching relay is widely applied to various fields, such as electric appliances, electricity, offices, communication and aerospace in the current society. An electromagnetic system of the magnetic latching relay uses a permanent magnet instead of traditional coil magnetization, an input form of the permanent magnet is a pulse electric signal having certain width, and a conversion control form of an on-off state of the permanent magnet is to input a trigger electric signal to the coil; and during operation, only a pulse signal needs to be added to the coil to realize attraction of the coil, without long-term electrified magnetization, the retention of a normally-opened or normally-closed state of the magnetic latching relay depends on magnetism storage of permanent magnetic steel, and therefore compared with the traditional electromagnetic relay, the magnetic latching relay has the characteristic of low power consumption and reliable to attract, thus satisfying the requirements of energy saving and environmental friendliness in the current society. The magnetic latching relay used for an electric card charge meter at present is subject to electrified magnetization by the coil to generate magnetism the same or opposite to that of the permanent magnet to rotate armature, so as to impel a pushing card to move, and at this moment, main contacts of the relay are closed or separated, and a circuit is switched on or switched off. In general, the relay only has a pair of movable or static contacts with large resistance and high temperature rise, over travel is generated by self deformation of a movable flat spring, and since the movable flat spring has a short lever force arm, in order to ensure the movement property, the contact retention force cannot be too large.

EP 2009665 B1 Patent discloses a bipolar relay which adopts a solution in which an anchoring rocker arm with a permanent magnet drives an adjusting part to slide in a deflecting direction of contact springs two monopole relays, wherein the anchoring rocker arm is located in the middle of the adjusting part, and both end parts of the adjusting part are movably coupled to contact springs of each monopole relay a contact device of each monopole relay respectively; and the bipolar relay has the defects residing in that the adjusting parts of two poles are of an integral structure and are unavailable for accurate orientation, which causes that contact parameters are hard to debug, thus giving rise to poor synchronism of the on-off actions of each relay contacts of two poles, obvious temperature rise of relay contacts, ideal closing/disconnecting stability and reliability of contacts and difficulty to installation and debugging. The main reason for these defects resides in that the problems of principle conflict of mechanism and unreasonable design are present, wherein the principle conflict of mechanisms is mainly reflected in two coupling mechanisms by which both end parts of the adjusting part are movably coupled to the two contact springs respectively, to be specific, 1, the synchronisms of the on-off actions of the relay contacts of two poles are not ideal owing to the presence of the movement property conflict, 2, the synchronisms consistence of contact property resistances of the contact relays of two poles are not ideal owing to the presence of the matching conflict, and 3, the assembly process of a product conflicts with debugging and correcting measures that are necessary to be adopted for realizing ideal properties owing to the presence of installing installation and debugging conflicts. Because the desynchrony of the on-off actions and the contact resistances of the two coupling mechanisms caused by manufacturing errors of relevant parts is inevitable, and when the on-off action property of one coupling mechanism changes, the on-off action property of the other coupling mechanism changes correspondingly, and therefore, it is unavailable to adopt a correcting measure of debugging the on-off action property of one coupling mechanism by reference to the on-off action property of the other coupling mechanism, to cause that the on-off actions of the relay contacts of two poles are hard unlikely to achieve the requirement of synchronism. In addition, when the contact pressure of contacts of one coupling mechanism changes, the contact pressure of contacts the other coupling mechanism changes correspondingly, and therefore it is unavailable to realize the purpose of synchronously debugging and correcting the contact pressures of the contacts of the two coupling mechanisms to ideal requirements. When the difference between the contact resistances of relay contacts of two poles are quite large: if the relay contacts of two poles are connected to a loading loop in series, the temperature rise will be concentrated toward the contact having larger contact resistance, such that the temperature rise of the contacts is quickened; but if the relay contacts of two poles control two loading loops respectively, the temperature rise of the two contacts are unbalanced, to affect the current-carrying capability of output loops. Further, because two coupling mechanism of the prior art are coupling fit with free ends of two contact springs and additional springs through one adjusting part, and meanwhile the adjusting part is also in connecting fit with the anchoring rocker arm, coupling cooperation among the anchoring rocker arm, the adjusting part, free ends of the two contact springs and two additional springs is necessary to reach the ideal degree in order to obtain ideal properties, however, under the restraint from the structure of one adjusting part and the principle of the coupling mechanisms, when coupling fit between the free end of one contact spring and/or one additional spring and the adjusting part is debugged, coupling fit between the free end of the contact spring of the other coupling mechanism and/or one additional spring and the adjusting part will change, thus causing very difficult assembly and debugging and affecting the promotion of the production efficiency and the product quality.

SUMMARY OF THE INVENTION

In order to overcome the defects of the prior art, an objective of the invention is to provide a bipolar magnetic latching relay which adopts two guide transmission parts that are respectively connected with two driving balls of a magnetic steel assembly and free ends of two groups of movable contacts, wherein two groups of movable contacts are pushed by two driving balls respectively to act, thus forming two output loops of which the on-off actions simultaneously control on/off of the two output loops, and the output loops have the capability of loading power current, thus not only reducing the temperature rise and ensuring the working reliability of the relay, but also ensuring that the whole relay is reasonable in design with compact structure and attractive appearance.

In order to realize said purpose, the invention adopts the following technical solutions.

The bipolar magnetic latching relay comprises a coil assembly 14 mounted inside a cavity formed by buckling a shell cover 8 and a base 3, a magnetic steel assembly 5 that contains a permanent magnet 59 and armatures 52, 53, 54 and 55, as well as a first contact device 1 and a second contact device 2 that are mounted at both sides of the base 3, wherein the magnetic steel assembly 5 is pivotally connected with the base 3 through a revolving pair 50, the magnetic steel assembly 5 swings between two positions under the driving of an electric signal of the coil assembly 4 and is retained in one swing position due to the permanent magnetic force of the magnetic steel assembly 5, and said swing synchronously the deflection of the first contact device 1 and the second contact device 2, such that a first movable contact 17 and a first static contact 16 on a free end 15 of a first movable flat spring 10 of the first contact device 1 are subjected to closed/disconnecting fit, and meanwhile a second movable contact 27 and a second static contact 26 on a free end 25 of a second movable flat spring 20 of the second contact device 2 are subjected to closed/disconnecting fit. The bipolar magnetic latching relay is characterized in that the magnetic steel assembly 5 is provided with a first driving head 56 and a second driving head 57 that rotate synchronously with the magnetic steel assembly 5, and both the first driving head 56 and the second driving head 57 extend to the outside from the same direction C of the magnetic steel assembly 5; the bipolar magnetic latching relay further comprises a guide transmission part 6 and a second guide transmission part 7 that connect each of the contact devices 1, 2 and the magnetic steel assembly 5, wherein a first guide mechanism that allows the first guide transmission part 6 to move along a swing direction of the free end 15 of the first movable flat spring 10 is provided between the first guide transmission part 6 and the base 3, a driven end 61 of the first guide transmission part 6 is connected with the first driving head 56 of the magnetic steel assembly 5 through a first driving connection structure, a driving end 62 of the first guide transmission part 6 is coupled to the free end 15 of the first movable flat spring 10 of the first contact device 1 through a first elastic transmission structure, a second guide mechanism that allows a second guide transmission part 7 to move along a swing direction of the free end 25 of the second movable flat spring 20 is provided between the second guide transmission part 7 and the base 3, the second driven end 71 of the second guide transmission part 7 is connected with the second driving end 57 of the magnetic steel assembly 5, and a driving end 72 of the second guide transmission part 7 is coupled to the free end 25 of the second movable flat spring 20 of the second contact device 2 through a second elastic transmission structure, such that the first guide transmission part 6 and the second guide transmission part 7 are the same in movement direction and simultaneously act.

Furthermore, as a preferred structure, the first guide mechanism comprises a guide groove 30 provided on the base 3 and a first sliding block 612 provided on the first guide transmission part 6, the first sliding block 612 is mounted in the sliding groove 30 and is in sliding fit with the guide groove 30, and the guiding direction of the guide groove 30 is parallel to the swing direction of the free end 15 of the first movable flat spring 10; and the second guide mechanism comprises a guide groove 30 provided on the base 3 and a second sliding block 712 provided on the second guide transmission part 7, the second sliding block 712 is mounted in the guide groove 30 and is in sliding fit with the guide groove 30, and the guiding direction of the guide groove 30 is parallel to the swing direction of the free end 25 of the second movable flat spring 20.

One kind of the preferred structure of the first elastic transmission structure and the second elastic transmission structure resides in that the first elastic transmission structure comprises a first guide sliding surface 621, a first disconnecting driving surface 622 and a first closing driving surface 623 that are provided on the driving end 62 of the first guide transmission part 6, and a first guide end surface 14, a first disconnecting side surface 150 and a first over-travel leaf spring 13 that are provided on the free end 15 of the first movable flat spring 10, wherein the first guide sliding surface 621 is in sliding fit with the first guide end surface 14, the first disconnecting driving surface 622 is butt fit with the first disconnecting side surface 150, and the first closing driving surface 623 is butt fit with the first over-travel leaf spring 13; and the second elastic transmission structure comprises a second guide sliding surface 721, a second disconnecting driving surface 722 and a second closing driving surface 723 that are provided on the driving end 72 of the second guide transmission part 7, and a second guide end surface 24, a second disconnecting side surface 250 and a second over-travel leaf spring 23 that are provided on the free end 25 of the second movable flat spring 20, wherein the second guide sliding surface 721 is in sliding fit with the second guide end surface 24, the second disconnecting driving surface 722 is in butt fit with the second disconnecting side surface 250, and the second closing driving surface 723 is in butt fit with the second over-travel leaf spring 23.

As another preferred structure of the first elastic transmission structure and the second elastic transmission structure resides in that the first elastic transmission structure comprises a first guide sliding rib 624, a first disconnecting driving surface 622 and a first closing driving surface 623 that are provided on the driving end 62 of the first guide transmission part 6, and a first guide lug 31 provided on the base 3, as well as a first disconnecting side surface 150 and a first over-travel leaf spring 13 that are provided on the free end 15 of the first movable flat spring 10, wherein the first guide sliding rib 624 is in sliding fit with the first guide lug 31, the first disconnecting driving surface 622 is in butt fit with the first disconnecting side surface 150, and the first closing driving surface 623 is in butt fit with the first over-travel leaf spring 13; and the second elastic transmission structure comprises a second guide sliding rib 724, a second disconnecting driving surface 722 and a second closing driving surface 723 that are provided on the driving end 72 of the second guide transmission part 7, and a second guide lug 32 provided on the base 3, as well as a second disconnecting side surface 250 and a second over-travel leaf spring 23 that are provided on the free end 25 of the second movable flat spring 20, wherein the second guide sliding rib 724 is in sliding fit with the second guide lug 32, the second disconnecting driving surface 722 is in butt fit with the second disconnecting side surface 250, and the second closing driving surface 723 is in butt fit with the second over-travel leaf spring 23.

Another preferred structure of the first elastic transmission structure and the second elastic transmission structure resides in that the first elastic transmission structure comprises a first disconnecting driving surface 622 and a first closing driving surface 623 that are provided on the driving end 62 of the first guide transmission part 6, as well as a first disconnecting side surface 150 and a first over-travel leaf spring 13 that are provided on the free end 15 of the first movable flat spring 10, wherein the first disconnecting driving surface 622 is in butt fit with the first disconnecting side surface 150, and the first closing driving surface 623 is in butt fit with the first over-travel leaf spring 13; and the second elastic transmission structure comprises a second disconnecting driving surface 722 and a second closing driving surface 723 that are provided on the driving end 72 of the second guide transmission part 7, as well as a second disconnecting side surface 250 and a second over-travel leaf spring 23 that are provided on the free end 25 of the second movable flat spring 20, wherein the second disconnecting driving surface 722 is in butt fit with the second disconnecting side surface 250, and the second closing driving surface 723 is in butt fit with the second over-travel leaf spring 23.

As a further preferred structure of the first elastic transmission structure and the second elastic transmission structure, the first elastic transmission structure comprises a first guide sliding surface 621, a first disconnecting driving surface 622, a first closing driving surface 623 and a first guide sliding rib 624 that are provided on the driving end 62 of the first guide transmission part 6, and a first guide end surface 14, a first disconnecting side surface 150 and a first over-travel leaf spring 13 that are provided on the free end 15 of the first movable flat spring 10, and further comprises a first guide lug 31 that is provided on the base 3, wherein the first guide sliding surface 621 is in sliding fit with the first guide end surface 14, the first disconnecting driving surface 622 is in butt fit with the first disconnecting side surface 150, the first closing driving surface 623 is in butt fit with the first over-travel leaf spring 13, and the first guide sliding rib 624 is in sliding fit with the first guide lug 31; and the second elastic transmission structure comprises a second guide sliding surface 721, a second disconnecting driving surface 722, a second closing driving surface 723 and a second guide sliding rib 724 that are provided on the driving end 72 of the second guide transmission part 7, and a second guide end surface 24, a second disconnecting side surface 250 and a second over-travel leaf spring 23 that are provided on the free end 25 of the second movable flat spring 20, and further comprises a second guide lug 32 that is provided on the base 3, wherein the second guide sliding surface 721 is in sliding fit with the second guide end surface 24, the second disconnecting driving surface 722 is in butt fit with the second disconnecting side surface 250, the second closing driving surface 723 is in butt fit with the second over-travel leaf spring 23, and the second guide sliding rib 724 is in sliding fit with the second guide lug 32.

Furthermore, as an optimized preferred structure, the first driving connection structure comprises a first connecting hole 611 provided in the driven end 61 of the first guide transmission part 6 and a spherical first driving head 56 that is provided on the magnetic steel assembly 5, and the first driving head 56 is mounted in the first connecting hole 611 and is in contact fit with the first connecting hole 611; and the second driving connection structure comprises a second connecting hole 711 provided in the second driven end 71 of the second guide transmission part 7 and a spherical second driving head 57 that is provided on the magnetic steel assembly 5, and the second driving head 57 is mounted in the second connecting hole 711 and is in contact fit with the second connecting hole 711.

In addition, as an optimized preferred structure of the revolving pair 50, the revolving pair 50 comprises a pivot 58 provided on the magnetic steel assembly 5, a first pivot hole formed in the base 3 and a positioning part 9 provided with a second pivot hole, and both ends of the pivot 58 are mounted in the first pivot hole and the second pivot hole respectively in a pivot fit manner, and the positioning part 9 is fixedly mounted in on the base 3. The As another preferred structure of the revolving pair 50, the revolving pair 50 comprises a pivot 58 provided on the magnetic steel assembly 5, a first pivot hole formed in the base 3 and a second pivot hole formed in a shell cover 8, both ends of the pivot 58 are mounted in the first pivot hole and the second pivot hole respectively in a pivot fit manner, and the shell cover 8 is fixedly connected with the base 3.

Moreover, as a preferred structure, a non-free end of the first movable flat spring 10 of the first contact device 1 is in U-shaped connection with a first movable connecting plate 11 and a first static connecting plate 12 respectively, and the first over-travel leaf spring 13 is a pressure leaf spring that participates in providing a final pressure for contacts; and the non-free end of the second movable flat spring 20 of the second contact device 2 is in U-shaped connection with a second movable connecting plate 21 and a second static connecting plate 22 respectively, and the second over-travel leaf spring 23 is a pressure leaf spring that participates in providing a final pressure for contacts.

The existing relay adopts one adjusting part such that a link for transferring movement is formed between two coupling mechanisms, and by means of the link, the action of one of the coupling mechanisms not only depends on normal control by an anchoring rocker arm, but also depends on surplus control by the other coupling mechanism, and the surplus control is harmful and will affect the action precision of the coupling mechanism, thus getting rise to harmful movement transfer between the two coupling mechanisms and harmful free movement present in the adjusting part. In addition, a design of a movement pair that connects the adjusting part and the free end of the contact spring lacks a necessary constraint of limiting the up-down movement of the adjusting part in addition that the connection between the anchoring rocker arm and the adjusting part has a seesaw-type fulcrum effect, such that the adjusting part at least has three fflat springom degrees of independent movement, wherein the fflat springom degree of transverse movement is design-specific, and the two fflat springom degrees of up-down movement and rotation around a fulcrum of the anchoring rocker arm are harmful and thus will affect the action precision of the existing coupling mechanisms. In allusion to the unreasonable design of the prior art, the bipolar magnetic latching relay of the present invention further adopts a first guide mechanism and a second guide mechanism in addition to adopting the first guide transmission part and the second guide transmission part to drive the first movable flat spring and the second movable flat spring respectively, such that two movement links that do not affect to each other are formed between the two coupling mechanisms, and therefore the movement constraint conditions between the two movement parts, namely the first guide transmission part and the second guide transmission part are perfected, the movement precision of the first guide transmission part and the second guide transmission part is greatly promoted, and thus the synchronism of the on-off actions between the two contact devices as well as the closing/disconnecting stability and reliability of contacts are effectively promoted, the current-loading and disconnecting capabilities of the bipolar magnetic latching relay are effectively enhanced, and the temperature rise is reduced. Meanwhile, a structure of preventing the driving end of each of the first guide transmission part and the second guide transmission part from sliding up and down is provided on the respective driving end to further promote the movement precision of the first guide transmission part and the second guide transmission part, such that the movable coupling property between respective first guide transmission part and second guide transmission part and respective first movable flat spring and second movable flat spring is better.

BRIEF DESCRIPTION OF THE DRAWINGS

The above features and technical advantages of the present invention are clearer and easily understood from the following description of the embodiments in conjunction with the accompanying drawings.

FIG. 3 is a planar schematic drawing representing the internal structure of the bipolar magnetic latching relay of the present invention of FIG. 1, wherein FIG. 3 illustrates the integral structure of the components, such as the coil assembly 4, the magnetic steel assembly 5, the first guide transmission part 6 and the second guide transmission part 7.

DETAILED DESCRIPTIONS OF THE PREFERRED EMBODIMENTS

The specific embodiments of the bipolar magnetic latching relay of the present invention are further illustrated as below in conjunction with the embodiments presented by FIGS. 1-12. The bipolar magnetic latching relay of the present invention is limited to the description of the following embodiments.

Figure 1:
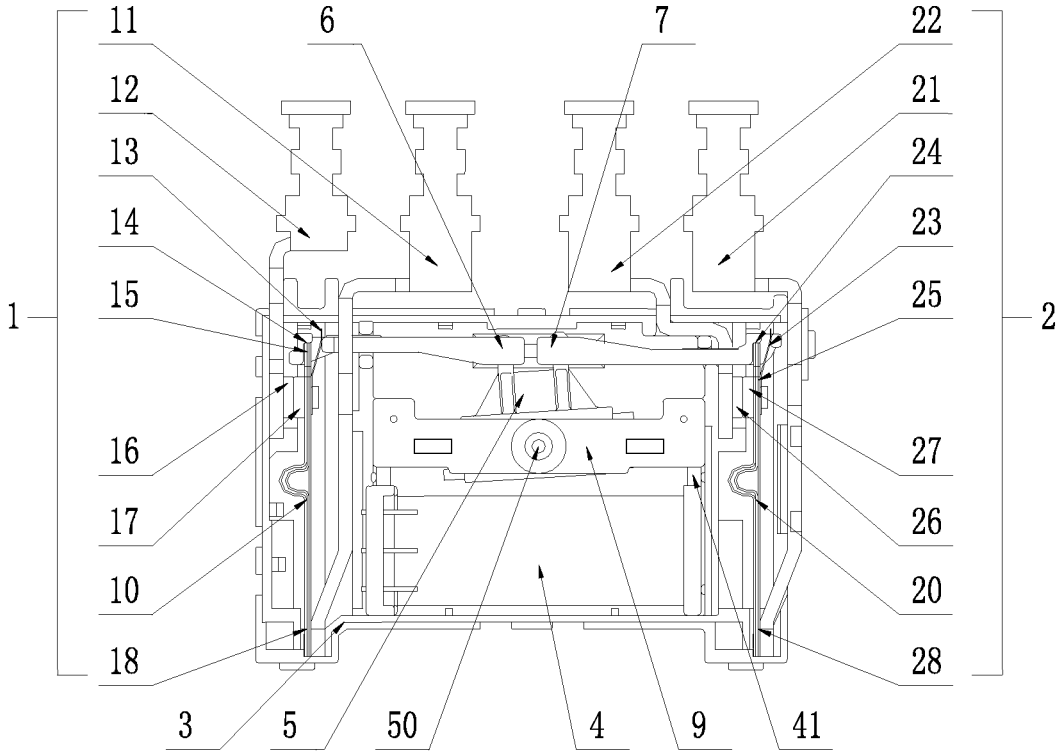
FIG. 1 is a planar schematic drawing representing the integral structure of the bipolar magnetic latching relay of the present invention.
Figure 2:
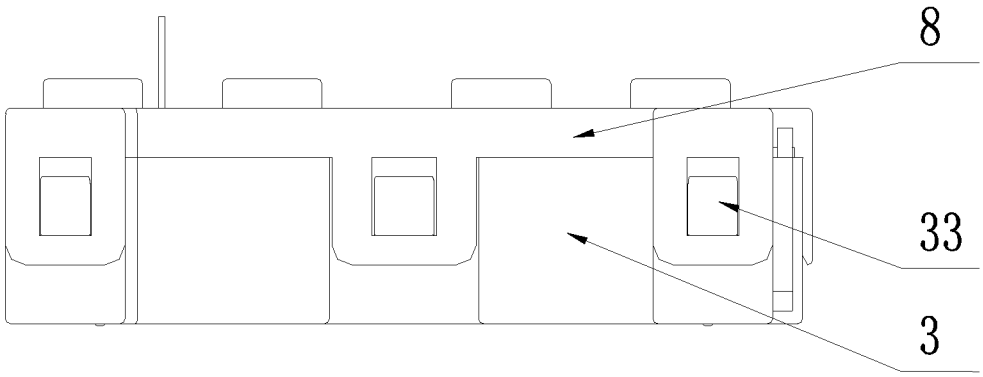
FIG. 2 is a planar schematic drawing representing the bottom-view appearance of FIG. 1.

FIG. 1 is the planar schematic drawing illustrating the integral structure of the bipolar magnetic latching relay of the present invention. As shown in FIG. 1, the bipolar magnetic latching relay of the present invention comprises a first contact device 1, a second contact device 2, a base 3, a coil assembly 4, a magnetic steel assembly 5, a first guide transmission part 6, a second guide transmission part 7 and a shell cover 8. The base 3 and the shell cover 8 are buckled by a buckle 33 and are fixedly connected to form a cavity 300 in which the first contact device 1, the second contact device 2, the base 3, the coil assembly 4, the magnetic steel assembly 5, the first guide transmission part 6 and the second guide transmission part 7 are mounted. An electromagnetic system of the relay, which consists of the coil assembly 4 with magnetic yokes and the magnetic steel assembly 5 that contains a permanent magnet 59 and armatures 52, 53, 54 and 55 is arranged in the middle of the base 3, contact systems consisting of movable contacts and static contacts of the first contact device 1 and the second contact device 2 are mounted on the base 3 and distributed at both sides of the electromagnetic system, the free ends of the movable flat springs 10, 20 are connected with the movable contacts 17, 27 and over-travel leaf springs 13, 23 together, and the magnetic steel assembly 5 is pivotally connected with the base 3 through a revolving pair 50. The magnetic steel assembly 5 swings between two positions under the driving of an electric signal of the coil assembly 4 and is retained in one swing position due to the permanent magnetic force of the magnetic steel assembly 5, and the swing synchronously drives the first contact device 1 and the second contact device 2 to deflect, the magnetic steel assembly 5 rotates to drive the first guide transmission part 6 and the second guide transmission part 7 that are separately formed on one straight line, via driving balls that are located at the top end of the magnetic steel assembly 5 in the same direction, the latter synchronously pushes drives the movable contacts at both sides to act, thus realizing on/off of a circuit, that is to say, a first movable contact 17 and a first static contact 16 on the free end 15 of the first movable flat spring 10 of the first contact device 1 are subjected to closing/disconnecting fit, and meanwhile a second movable contact 27 and a second static contact 26 of the free end 25 of the second movable flat spring 20 of the second contact device 2 are subjected to closing/disconnecting fit.

Figure 10:
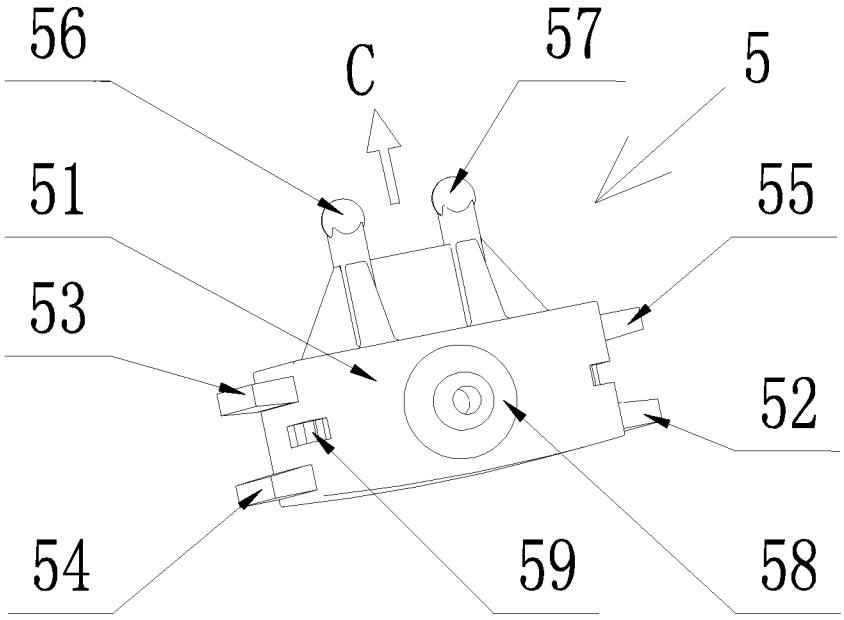
FIG. 10 is a schematic drawing representing the stereoscopic structure of the magnetic steel assembly 5.
Figure 11:
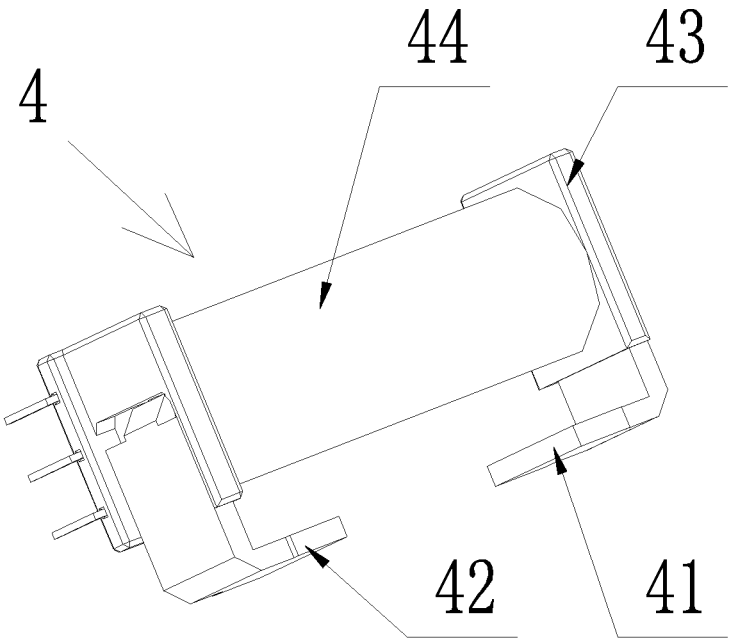
FIG. 11 is a schematic drawing representing the stereoscopic structure of the coil assembly 4.
Figure 12:
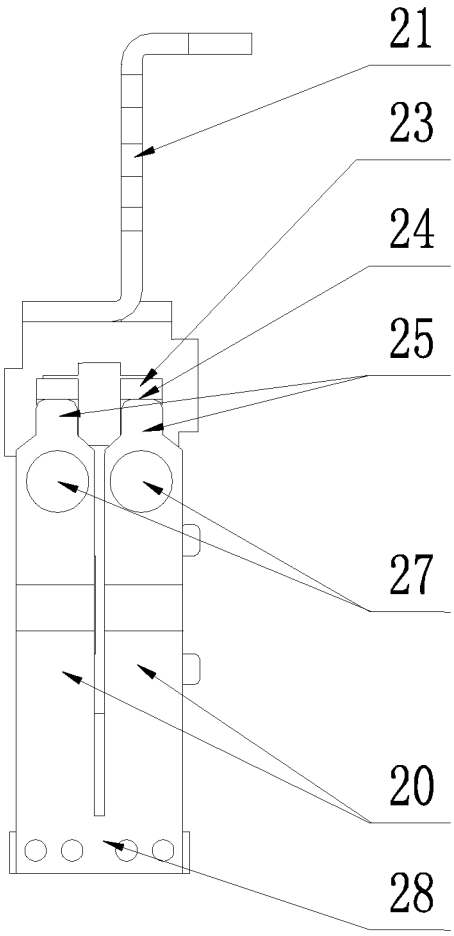
FIG. 12 is a schematic drawing illustrating the planar structure of the movable flat spring 20 of the second contact device.

As shown in FIG. 10, the magnetic steel assembly 5 is provided with a first driving head 56 and a second driving head 57 that synchronously rotate therewith, and both the first driving head 56 and the second driving head 57 extend to the outside from the same direction C of the magnetic steel assembly 5; and the first guide transmission part 6 and the second guide transmission part 7 are used for establishing a transmission connection between each of the contact devices 1, 2 and the magnetic steel assembly 5, to be specific, a first guide mechanism that allows the first guide transmission part 6 to move along a swing direction of the free end 15 of the first movable flat spring 10 is provided between the first guide transmission part 6 and the base 3, a driven end 61 of the first guide transmission part 6 is connected with the first driving head 56 of the magnetic steel assembly 5 through a first driving connection structure, a driving end 62 of the first guide transmission part 6 is coupled to the free end 15 of the first movable flat spring 10 of the first contact device 1 through a first elastic transmission structure, a second guide mechanism that allows the second guide transmission part 7 to move along a swing direction of the free end 25 of the second movable flat spring 20 is provided between the second guide transmission part 7 and the base 3, a second driven end 71 of the second guide transmission part 7 is connected to the second driving end 57 of the magnetic steel assembly 5 through a second driving connection structure, and a driving end 72 of the second guide transmission part 7 is coupled to the free end 25 of the second movable flat spring 20 of the second contact device 2 through a second elastic transmission structure, with the purpose of allowing the first guide transmission part 6 and the second guide transmission part 7 to be the same in movement direction and simultaneously act.

Figure 3:
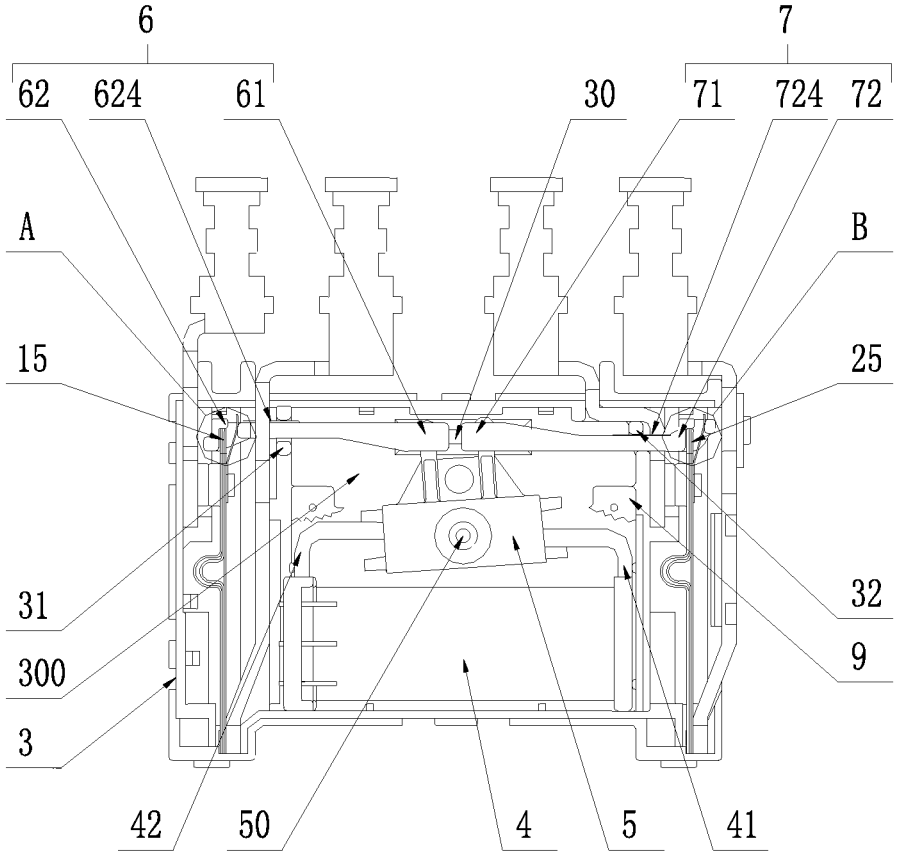
Figure 4:
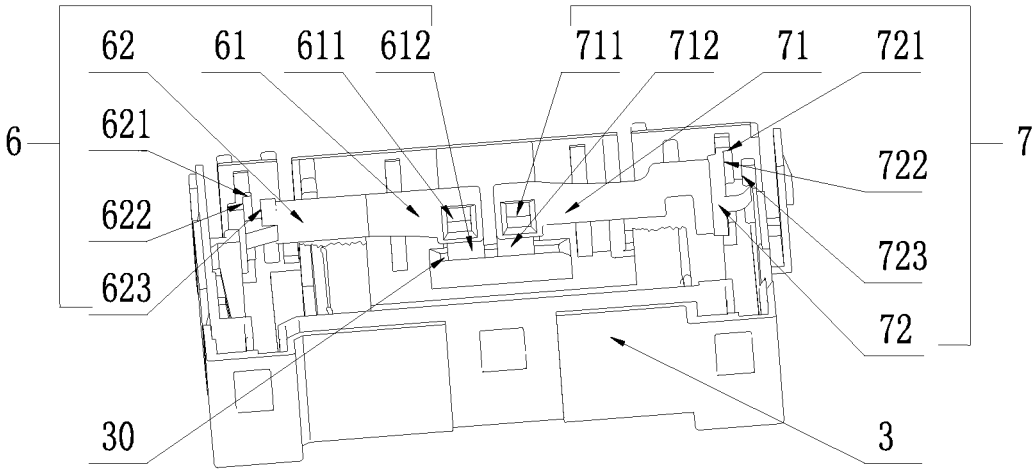
FIG. 4 is a stereoscopic schematic drawing representing the local structure of the first guide transmission part 6 and the second guide transmission part 7 of FIG. 1.
Figure 5:
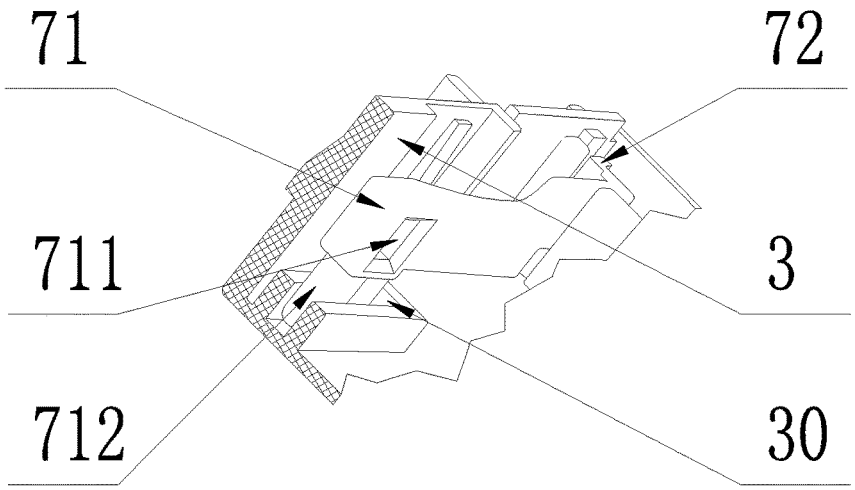
FIG. 5 is a stereoscopic schematic drawing representing the local structure of the second guide mechanism of the second guide transmission part 7 of FIG. 1.
Figure 6:
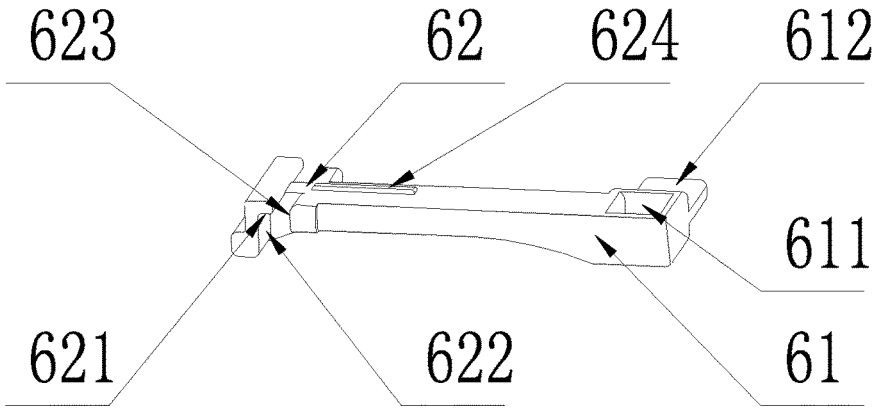
FIG. 6 is a schematic drawing representing the stereoscopic structure of the first guide transmission part 6.
Figure 7:
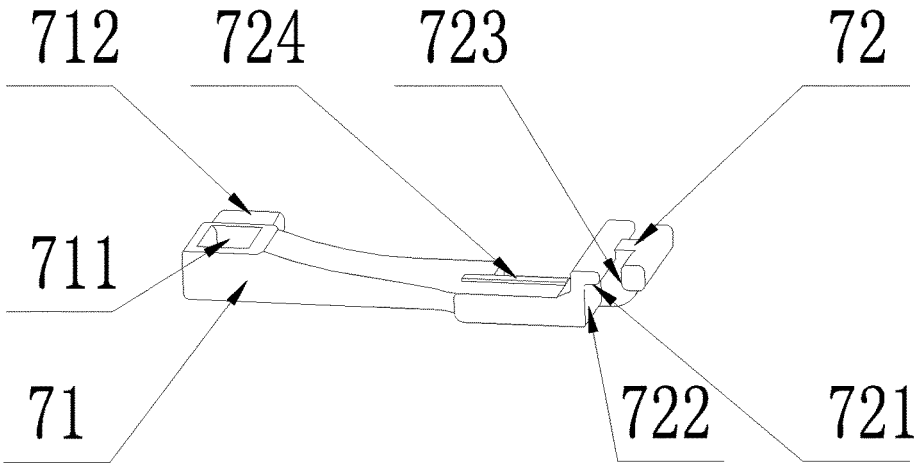
FIG. 7 is a schematic drawing presenting the stereoscopic structure of the second guide transmission part 7.
Figure 8:
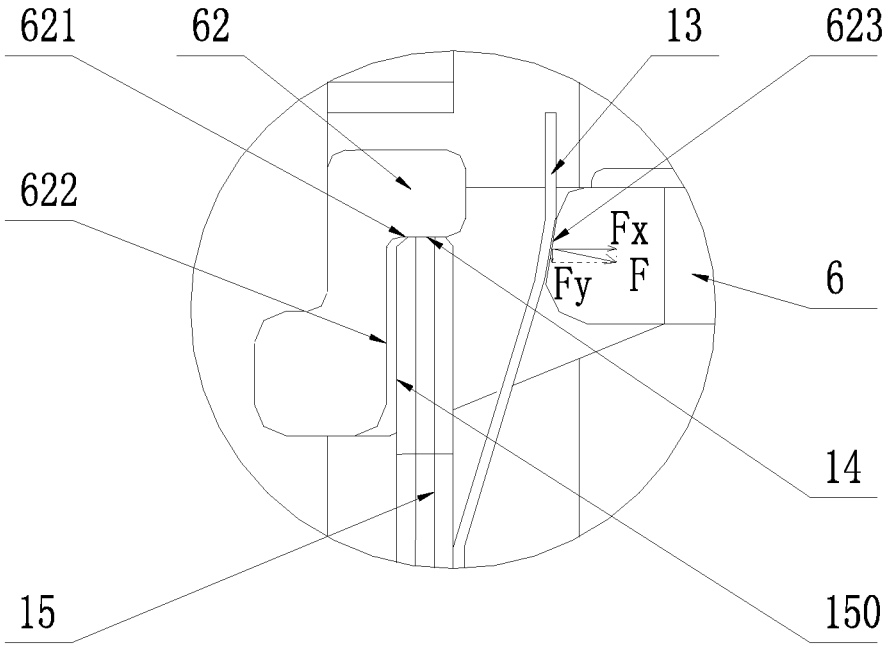
FIG. 8 is an enlarged drawing of the portion A of FIG. 3, which specifically illustrates the first elastic transmission structure between the first guide transmission part 6 and the first movable flat spring 10 of the first contact device 1, wherein the first movable flat spring 10 of FIG. 8 is at a closed state.
Figure 9:
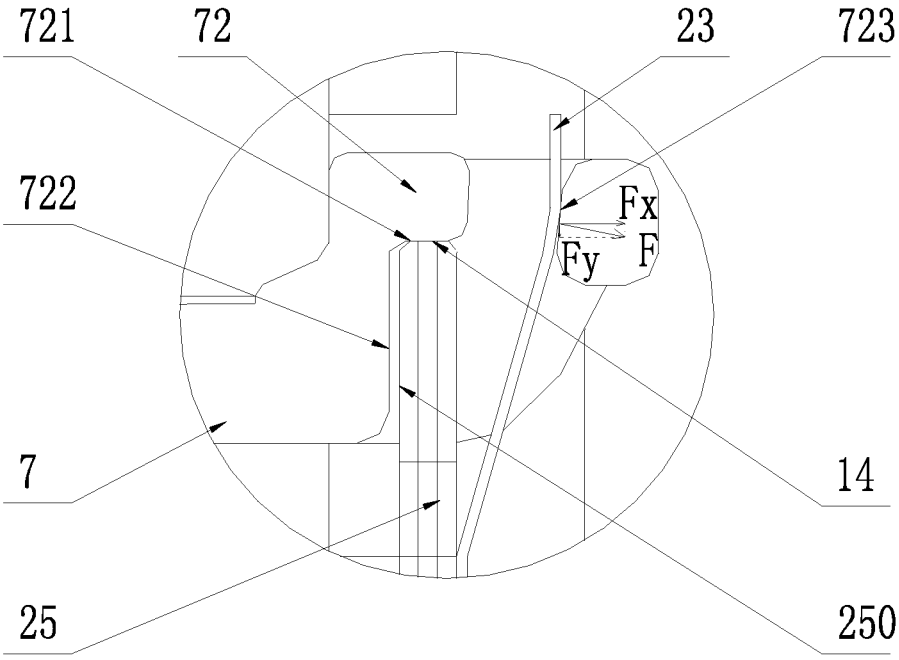
FIG. 9 is an enlarged drawing of the portion B of FIG. 3, which specifically illustrates the second elastic transmission structure between the first second guide transmission part 7 and the first second movable flat spring 20 of the first second contact device 2, wherein the second movable flat spring 20 as shown in of FIG. 9 is at a closed state.

Referring to FIGS. 1, 2, 8 and 9, the first contact device 1 is an output loop of a first pole and comprises a first movable connecting plate 11, a first static connecting plate 12, a first movable flat spring 10, a first over-travel leaf spring 13, a first static contact 16 and a first movable contact 17, wherein one end of the first movable connecting plate 11 extends out of the cavity 300 for a purpose of wiring, and the other end of the first connecting plate 11 is located in the cavity 300 and fixedly mounted on the base 3; one end of the first movable flat spring 10 is a first fixed end 18 which is fixedly connected with the other end of the first movable connecting plate 11; the other end of the first movable flat spring 10 is a free end 15 which can swing with the first fixed end 18 as a fulcrum; one end of the first over-travel leaf spring 13 is fixedly connected with the free end 15 of the first movable flat spring 10 to form a cantilever structure; the first movable contact 17 is fixed on the free end 15 of the first movable flat spring 10 and swings with the free end 15 together with the first over-travel leaf spring 14; similarly, one end of the first static connecting plate 12 extends out of the cavity 300 for a purpose of wiring, the other end of the first static connecting plate 12 is located in the cavity 300 and is fixedly mounted on the base 3, and the first static contact 16 is fixed on the first static connecting plate 12. When the first guide transmission part 6 pushes the first over-travel leaf spring 13 towards a closing direction of contacts, the first over-travel leaf spring 13 drives the free end 15 and the first movable contact 17 on the free end 15 to swing towards the direction of the first static contact 16 till the first movable contact 17 and the first static contact 16 contact to be closed, such that the first movable connecting plate 11 and the first static connecting plate 12 are electrically switched on, and under a closed state as shown in FIGS. 1, 3 and 8, the first over-travel leaf spring 13 provides an elastic pressure for the first movable contact 17 and the first static contact 16. When the first guide transmission part 6 pushes the free end 15 towards a disconnecting direction, the free end 15 drives the first over-travel leaf spring 13 on the free end to be separated from the first movable contact 17 and the first static contact 16, such that the first movable connecting plate 11 and the first static connecting plate 12 are electrically separated. By means of the above-mentioned structure, the closing/disconnecting fit between the first movable contact 17 and the first static contact 16 on the free end 15 of the first movable flat spring 10 of the first contact device 1 is realized. The second contact device 2 is an output loop of a second pole and comprises a second movable connecting plate 21, a second static connecting plate 22, a second movable flat spring 20, a second over-travel leaf spring 23, a second static contact 26 and a second movable contact 27, wherein one end of the second movable connecting plate 22 extends out of the cavity 300 for a purpose of wiring, and the other end of the second static connecting plate 22 is located in the cavity 300 and fixedly mounted on the base 3; one end of the second movable flat spring 20 is a second fixed end 28 which is fixedly connected with the other end of the second movable connecting plate 22; the other end of the second movable flat spring 20 is a free end 25 which can swing with the second fixed end 28 as a fulcrum; one end of the second over-travel leaf spring 23 is fixedly connected with the free end 25 of the second movable flat spring 20 to form a cantilever structure; the second movable contact 27 is fixed on the free end 25 of the second movable flat spring 20 and swings with the free end 25 together with the second over-travel leaf spring 23; similarly, one end of the second static connecting plate 21 extends out of the cavity 300 for a purpose of wiring, the other end of the second static connecting plate 21 is located in the cavity 300 and is fixedly mounted on the base 3, and the second static contact 26 is fixed on the second static connecting plate 21. When the second guide transmission part 7 pushes the second over-travel leaf spring 23 towards a closing direction of contacts, the second over-travel leaf spring 23 drives the free end 25 and the second movable contact 27 on the free end 25 to swing towards the direction of the second static contact 26 till the second movable contact 27 and the second static contact 26 contact to be closed, such that the second movable connecting plate 21 and the second static connecting plate 22 are electrically switched on, and under a closed state as shown in FIGS. 1, 3 and 9, the second over-travel leaf spring 23 provides an elastic pressure for the second movable contact 27 and the second static contact 26. When the second guide transmission part 7 pushes the free end 25 towards a disconnecting direction, the free end 25 drives the second over-travel leaf spring 23 on the free end to be separated from the second movable contact 27 and the second static contact 26, such that the second movable connecting plate 21 and the second static connecting plate 22 are electrically separated. By means of the above-mentioned structure, the closing/disconnecting fit between the second movable contact 27 and the second static contact 26 on the free end 25 of the second movable flat spring 20 of the second contact device 2 is realized. The first contact device 1 and the second contact device 2 are the same in the closing/disconnecting direction, namely, in the connecting process, the free end 15 of the first over-travel leaf spring 13 of the first contact device 1 has the same swing direction with the free end 25 of the second over-travel leaf spring 23 of the second contact device 2.

By referring to FIGS. 1, 3 and 10, the magnetic steel assembly 5 comprises a shell 51, a permanent magnet 59 mounted in the shell 51, a first N terminal 54, a first S terminal 55, a second N terminal 52 and a second S terminal 53 that extend outwards from the interior of the shell 51, as well as a first driving head 56 and a second driving head 57 that are used for driving the first guide transmission part 6 and the second guide transmission part 7 respectively. In the embodiment as shown in FIG. 10, the first S terminal 55 and the second S terminal 53 are located on the upper side (namely the S pole of the permanent magnet 59 is on the upper side), the first N terminal 54 and the second N terminal 52 are on the lower side (namely the N pole of the permanent magnet 59 is on the lower side), and the solution equivalent thereto resides in that the first S terminal 55 and the second S terminal 53 are on the lower side (namely the S pole of the permanent magnet 59 is on the lower side), and the first N terminal 54 and the second N terminal 52 are on the upper side (namely the N pole of the permanent magnet 59 is on the upper side). The first driving head 56 and the second driving head 57 extend to the outside from the same direction C of the magnetic steel assembly 5 and are integrally formed with the shell 51, thus being capable of synchronously rotating with the magnetic steel assembly 5. The first N terminal 54 and the second N terminal 52 are connected with the N pole of the permanent magnet 59 through a magnetic circuit, the first S terminal 55 and the second S terminal 53 are connected with the S pole of the permanent magnet 59 through a magnetic circuit, and such connection may be realized by well-known methods, for example, by guiding both ends of one armature out from the S pole of the permanent magnet 59 to form the first N terminal 54 and the second N terminal 52 and guiding another armature out from the S pole of the permanent magnet 59 to form the second S terminal 53 and the first S terminal 55, and therefore the first N terminal 54 and the second N terminal 52 are N poles of the permanent magnet 59 respectively, and the first S terminal 55 and the second S terminal 53 are S poles of the permanent magnet 59 respectively. When the first magnetic yoke 41 and the second magnetic yoke 42 of the coil assembly 4 are free of exciting electromagnetism, the permanent magnetic force of the permanent magnet 59 still enables the magnetic steel assembly 5 to be kept at a current state (namely the state at the moment when an electric signal is removed from the coil assembly 4). The pivotal connection between the magnetic steel assembly 5 and the base 3 through the revolving pair 50 refers to that only one fflat springom degree of rotation around a rotation center of the magnetic steel assembly 5 is available after being the magnetic steel assembly 5 is mounted on the base 3, multiple solutions for implementing the revolving pair 50 may be available, wherein one optimized preferred solution resides in that: the revolving pair 50 comprises a pivot 58 provided on the magnetic steel assembly 5, a first pivot hole (not shown in Drawings) formed in the base 3 and a positioning part 9 provided with a second pivot hole (not shown in Drawings), wherein both ends of the pivot 58 are mounted in the first pivot hole and the second pivot hole in a pivot fit manner respectively, and the positioning part 9 is fixedly mounted on the base 3. This solution is a preferred alternate alternative solution which has higher rotation precision and is easy to assemble and debug at the same time. Another solution resides in that: the revolving pair 50 comprises a pivot 58 provided on the magnetic steel assembly 5, a first pivot hole (not shown in Drawings) formed in the base 3 and a second pivot hole (not shown in Drawings) formed in the shell cover 8, wherein both ends of the pivot 58 are mounted in the first pivot hole and the second pivot hole in a pivot fit manner respectively, and the shell cover 8 is fixedly connected with the base 3. This solution has the advantage that the positioning part 9 can be omitted, but has lower rotation precision while the difficulty in fixed connection between the shell cover 8 and the base 3 is increased.

Referring to FIGS. 1, 3, 10 and 11, the coil assembly 4 comprises a first magnetic yoke 41, a second magnetic yoke 42, a coil rack 43 and a coil 44, wherein the coil 44 is sheathed outside the coil rack 43, and the first magnetic yoke 41 and the second magnetic yoke 42 are respectively inserted into the coil rack 43 to form a magnetic circuit connection in the coil rack 43. When a voltage/current (a pulse electric signal having certain width, for example) is loaded to the coil 44 through well-known methods, a magnetic field is generated on the first magnetic yoke 41 and the second magnetic yoke 42, and the polarity of the first magnetic yoke 41 is opposite to that of the second magnetic yoke 42; when the polarity of the loaded pulse electric signal changes, the polarity of the first magnetic yoke 41 and the polarity of the second magnetic yoke 42 are converted correspondingly. The first magnetic yoke 41 of the coil assembly 4 is in attraction/repulsion fit with the first N terminal 54 and the first S terminal 55 of the magnetic steel assembly 5, and the second magnetic yoke 42 of the coil assembly 4 is in attraction/repulsion fit with the second N terminal 52 and the second S terminal 53 of the magnetic steel assembly 5, and the second magnetic yoke 42 of the coil assembly 4 is in pull-in/repulsion fit with the second N terminal 52 and the second S terminal 53 of the magnetic steel assembly 5, namely when the loaded pulse electric signal enables the first magnetic yoke 41 to be an N pole and the second magnetic yoke 42 to be an S pole, the first S terminal 55 and the first magnetic yoke 41 are attracted to each other, the first N terminal 54 is repelled from the first magnetic yoke 41, the second N terminal 52 and the second magnetic yoke 42 are attracted to each other and the second S terminal 53 is repelled from the second magnetic yoke 42, and therefore the magnetic steel assembly 5 is driven to deflects leftwards till reaching a state as shown in FIG. 3. When the loaded pulse electric signal enables the first magnetic yoke 41 to be an S pole and the second magnetic yoke 42 to be an N pole, the first S terminal 55 is repelled from the first magnetic yoke 41, the first N terminal 54 and the first magnetic yoke 41 are attracted to each other, the second N terminal 52 is repelled from the second magnetic yoke 42 and the second S terminal 53 and the second magnetic yoke 42 are attracted to each other, and therefore the magnetic steel assembly 5 is driven to deflect rightwards (namely deflects in a clockwise direction as shown in FIG. 3) and is stabilized at an attraction state of deflecting rightwards (not shown in drawings). In the attraction state, even the electric signal loaded to the coil assembly 4 is removed, the magnetic force of the permanent magnet 59 in the magnetic steel assembly 5 still can enable the magnetic steel assembly 5 to be maintained at the current attraction state. It can thus be seen that the pulse electric signal is just to drive the magnetic steel assembly 5 to be converted into a deflection state, and the state of the magnetic steel assembly 5 is maintained in need of the magnetic force of the permanent magnet 59.

Referring to FIGS. 1, 3, 4, 6 and 7, a first guide mechanism by which the first guide transmission part 6 moves along a swing direction of the free end 15 of the first movable flat spring 10 is arranged between the first guide transmission part 6 and the base 3. The first guide mechanism may have a plurality of structure solutions, wherein one preferred solution resides in that: the first guide mechanism comprises a guide groove 30 provided on the base 3 and a first sliding block 612 provided on the first guide transmission part 6, the guiding direction of the guide groove 30 is parallel to the swing direction of the free end 15 of the first movable flat spring 10, and the first sliding block 612 is mounted in the guide groove 30 and is in sliding fit with the guide groove 30. The guiding direction of the guide groove 30 refers to a direction that allows the first sliding block 612 to slide in the guide groove 30, namely the length direction of the guide groove 30. The guide groove 30 can limit the movement of the first sliding block 612 in a width direction and a depth direction of the guide groove 30, both the width direction and the depth direction of the guide groove 30 are perpendicular to the guiding direction thereof, a rectangular sliding block can be adopted as the first sliding block 612, and therefore the first guiding mechanism limits that the first guide transmission part 6 only has one fflat springom degree of linear movement, the direction of linear movement is consistent with the swing direction of the free end 15 of the first movable flat spring 10, and thereby such structure greatly improves the movement precision of the first guide transmission part 6 and effectively overcomes a variety of defects caused by unreasonable design of a movement pair. The first guide transmission part 6 is a rodlike member one end of which is a driven end 61 and the other end is a driving end 62. The driven end 61 is connected with the first driving head 56 of the magnetic steel assembly 5 through a first driving connection structure, the deflection action of the magnetic steel assembly 5 is transferred to the first guide transmission part 6 through the first driving connection structure, and by means of the transmission chain, the deflecting swing of the magnetic steel assembly 5 is converted to linear movement of the first guide transmission part 6. There may be a plurality of specific implementations for the first driving connection structure, wherein one preferred implementation resides in that: the first driving connection structure comprises a first connecting hole 611 formed in the driven end 61 of the first guide transmission part 6 and a spherical first driving head 56 provided on the magnetic steel assembly 5, and the first driving head 56 is mounted in the first connecting hole 611 and is in contact fit with the first connecting hole 611. Such driving connection structure not only has high transmission precision, but also has a deflecting swing-linear movement conversion function.

In the same way, a second guide mechanism by which the second guide transmission part 7 moves along the swing direction of the free end 25 of the second movable flat spring 20 is provided between the second guide transmission part 7 and the base 3. A plurality of structure solutions may be available for the second guide mechanism, wherein one optimized preferred solution resides in that: the second guide mechanism comprises a guide groove 30 provided on the base 3 and a second sliding block 712 provided on the second guide transmission part 7, the guiding direction of the guide groove 30 is parallel to the swing direction of the free end 25 of the second movable flat spring 20, and the second sliding block 712 is mounted in the guide groove 30 and is in sliding fit with the guide groove 30. A rectangular sliding block can be adopted as the second sliding block 712, and therefore the second guiding mechanism limits that the second guide transmission part 7 only has one fllat springom degree of linear movement, and the direction of linear movement is consistent with the swing direction of the free end 25 of the second movable flat spring 20. The second guide transmission part 7 is a rodlike member one end of which is a second driven end 71 and the other end is a driving end 72. The second driven end 71 is connected with the second driving head 57 of the magnetic steel assembly 5 through a second driving connection structure, the deflection action of the magnetic steel assembly 5 is transferred to the second guide transmission part 7 through the second driving connection structure, and by means of the transmission chain, the deflecting swing of the magnetic steel assembly 5 is converted to linear movement of the second guide transmission part 7. A plurality of specific implementation solutions may be available for the second driving connection structure, wherein one preferred solution resides in that: the second driving connection structure comprises a second connecting hole 711 formed in the driven end 71 of the second guide transmission part 7 and a spherical second driving head 57 provided on the magnetic steel assembly 5, and the second driving head 57 is mounted in the second connecting hole 711 and is in contact fit with the second connecting hole 711. The guide groove 30 is additionally provided with the base 3, and the two guiding transmission parts are provided with guide ribs and contact guide devices, such that the first guide transmission part 6 and the second guide transmission part 7 are the same in movement direction and synchronously act, and the two guide transmission parts can realize the movement in the horizontal direction furthest, effectively adjust the contact parameters, avoid desynchrony of two phases caused by inclination of the transmission parts and increase the contact pressure.

Referring to 1, 3, 4, 6, 8 and 10, the driving end 62 of the first guide transmission part 6 is movably coupled to the free end 15 of the first movable flat spring 10 through a first elastic transmission structure, and by means of the movement being together upon this coupling, the first guide transmission part 6 transfers actions to the free end 15 of the first movable flat spring 10, and the linear movement of the first guide transmission part 6 is converted into deflecting swing of the free end 15 to drive closing/disconnecting of the first movable contact 17 and the first static contact 16. A plurality of specific solutions may be available for the first elastic transmission structure, and may be divided into four implementation forms according to the difference of properties of preventing the driving end 62 of the first guide transmission 6 from swinging up and down. The property that the driving end 62 swings up and down is associated to a process during which the first guide transmission part 6 controls the free end 15 of the first movable flat spring 10 to do a closing/disconnecting operation, and with respect to the amplitude of up-down free slippage of the free end 15, the larger the slippage is and the larger the harm is. Although the first guide mechanism has a favorable function of preventing the slippage, the effect of achieving the result with half effort can be achieved still since the first elastic transmission structure contains a structure of preventing the slippage, in order to further strength the technical effect pursued for the purpose of the present invention. Four preferred solutions for the first elastic transmission structure having different anti-slippage properties are proposed as below.

The first solution resides in that: the first elastic transmission structure comprises a first guide sliding surface 621, a first disconnecting driving surface 622 and a first closing driving surface 623 that are provided on the driving end 62 of the first guide transmission part 6, and a first guide end surface 14, a first disconnecting side surface 150 and a first over-travel leaf spring 13 that are provided on the free end 15 of the first movable flat spring 10, wherein the first guide sliding surface 621 is in sliding fit with the first guide end surface 14, the first disconnecting driving surface 622 is in butt fit with the first disconnecting side surface 150, and the first closing driving surface 623 is in butt fit with the first over-travel leaf spring 13. It is obvious that the sliding fit between the first guide sliding surface 621 and the first guide end surface 14 can further prevent downward slippage of the driving end 62. In order to further prevent upward slippage of the driving end 62, the following matched solution may be selected: under the butt joint state during a butt fit process of the first closing driving surface 623 and the first over-travel leaf spring 13 of the first elastic transmission structure, the elastic force F that the first over-travel leaf spring 13 acts to the first closing driving surface 623 includes a component force Fy that drives the first closing driving surface 623 to move downwards.

The second solution resides in that: the first elastic transmission structure comprises a first guide sliding surface 621, a first disconnecting driving surface 622, a first closing driving surface 623 and a first guide sliding rib 624 that are provided on the driving end 62 of the first guide transmission part 6, and a first guide end surface 14, a first disconnecting side surface 150 and a first over-travel leaf spring 13 that are provided on the free end 15 of the first movable flat spring 10, and further comprises a first guide lug 31 that is provided on the base 3, wherein the first guide sliding surface 621 is in sliding fit with the first guide end surface 14, the first disconnecting driving surface 622 is in butt fit with the first disconnecting side surface 150, the first closing driving surface 623 is in butt fit with the first over-travel leaf spring 13, and the first guide sliding rib 624 is in sliding fit with the first guide lug 31. It is obvious that the sliding fit between the first guide sliding surface 621 and the first guide end surface 14 can further prevent downward slippage of the driving end 62, and the sliding fit between the first guide sliding rib 624 and the first guide lug 31 can further prevent upward slippage of the driving end 62.

The third solution resides in that: the first elastic transmission structure comprises a first guide sliding rib 624, a first disconnecting driving surface 622 and a first closing driving surface 623 that are provided on the driving end 62 of the first guide transmission part 6, and a first guide lug 31 provided on the base 3 as well as a first disconnecting side surface 150 and a first over-travel leaf spring 13 that are provided on the free end 15 of the first movable flat spring 10, wherein the first guide sliding rib 624 is sliding fit with the first guide lug 31, the first disconnecting driving surface 622 is butt fit with the first disconnecting side surface 150, and the first closing driving surface 623 is butt fit with the first over-travel leaf spring 13. It is obvious that the sliding fit between the first guide sliding rib 624 and the first guide lug 31 can further prevent upward slippage of the driving end 62.

The fourth solution resides in that: the first elastic transmission structure comprises a first disconnecting driving surface 622 and a first closing driving surface 623 that are provided on the driving end 62 of the first guide transmission part 6, as well as a first disconnecting side surface 150 and a first over-travel leaf spring 13 that are provided on the free end 15 of the first movable flat spring 10, wherein the first disconnecting driving surface 622 is in butt fit with the first disconnecting side surface 150, and the first closing driving surface 623 is in butt fit with the first over-travel leaf spring 13. It is obvious that such first elastic transmission structure does not comprise a structure of preventing the driving end 62 from sliding up and down.

The above-mentioned butt fit refers to a fit being both butted and separated, for instance, under a closing state, the first closing driving surface 623 is in butt joint to the first over-travel leaf spring 13, and the first disconnecting driving surface 622 may be separated from the first disconnecting side surface 150. For another example, under a disconnecting state, the first disconnecting driving surface 622 is butt joint to the first disconnecting side surface 150, and the first closing driving surface 623 may be separated from the first over-travel leaf spring 13.

Referring to 1, 3, 4, 5, 7, 9 and 10, the driving end 72 of the second guide transmission part 7 is coupled to the free end 25 of the second movable flat spring 20 through a second elastic transmission structure, and by means of this coupling, the second guide transmission part 7 transfers actions to the free end 25 of the second movable flat spring 20, and the linear movement of the second guide transmission part 7 is converted into deflecting swing of the free end 25 to drive closing/disconnecting of the second movable contact 27 and the second static contact 27. Although the second guide mechanism has a favorable function of preventing the slippage, the effect of achieving the result with half effort can be achieved still since the second elastic transmission structure contains a structure of preventing the slippage, in order to further strength the technical effect pursued for the purpose of the present invention. A plurality of specific solutions may be available for the second elastic transmission structure, and may be divided into four implementation forms according to the difference of properties of preventing the driving end 72 of the second guide transmission 7 from swinging up and down.

The first solution resides in that: the second elastic transmission structure comprises a second guide sliding surface 721, a second disconnecting driving surface 722 and a second closing driving surface 723 that are provided on the driving end 72 of the second guide transmission part 7, as well as a second guide end surface 24, a second disconnecting side surface 250 and a second over-travel leaf spring 23 that are provided on the free end 25 of the second movable flat spring 20, wherein the second guide sliding surface 721 is in sliding fit with the second guide end surface 24, the second disconnecting driving surface 722 is in butt fit with the second disconnecting side surface 250, and the second closing driving surface 723 is in butt fit with the second over-travel leaf spring 23. It is obvious that the sliding fit between the second guide sliding surface 721 and the second guide end surface 24 can further prevent downward slippage of the driving end 72. In order to further prevent upward slippage of the driving end 72, the following matched solution may be selected: under the butt joint state during a butt fit process of the second closing driving surface 723 and the second over-travel leaf spring 23 of the second elastic transmission structure, the elastic force F that the second over-travel leaf spring 23 acts to the second closing driving surface 723 includes a component force Fy that drives the second closing driving surface 723 to move downwards.

The second solution resides in that: the second elastic transmission structure comprises a second guide sliding surface 721, a second disconnecting driving surface 722, a second closing driving surface 723 and a second guide sliding rib 724 that are provided on the driving end 72 of the second guide transmission part 7, and a second guide end surface 24, a second disconnecting side surface 250 and a second over-travel leaf spring 23 that are provided on the free end 25 of the second movable flat spring 20, and further comprises a second guide lug 32 that is provided on the base 3, wherein the second guide sliding surface 721 is in sliding fit with the second guide end surface 24, the second disconnecting driving surface 722 is in butt fit with the second disconnecting side surface 250, the second closing driving surface 723 is in butt fit with the second over-travel leaf spring 23, and the second guide sliding rib 724 is in sliding fit with the second guide lug 32. It is obvious that the sliding fit between the second guide sliding surface 721 and the second guide end surface 24 can further prevent downward slippage of the driving end 72, and the sliding fit between the second guide sliding rib 724 and the second guide lug 32 can further prevent upward slippage of the driving end 72.

The third solution resides in that: the second elastic transmission structure comprises a second guide sliding rib 724, a second disconnecting driving surface 722 and a second closing driving surface 723 that are provided on the driving end 72 of the second guide transmission part 7, and a second guide lug 32 provided on the base 3, as well as a second disconnecting side surface 250 and a second over-travel leaf spring 23 that are provided on the free end 25 of the second movable flat spring 20, wherein the second guide sliding rib 724 is sliding fit with the second guide lug 32, the second disconnecting driving surface 722 is in butt fit with the second disconnecting side surface 250, and the second closing driving surface 723 is in butt fit with the second over-travel leaf spring 23. It is obvious that the sliding fit between the second guide sliding rib 724 and the second guide lug 32 can further prevent upward slippage of the driving end 72.

The fourth solution resides in that: the second elastic transmission structure comprises a second disconnecting driving surface 722 and a second closing driving surface 723 that are provided on the driving end 72 of the second guide transmission part 7, as well as a second disconnecting side surface 250 and a second over-travel leaf spring 23 that are provided on the free end 25 of the second movable flat spring 20, wherein the second disconnecting driving surface 722 is in butt fit with the second disconnecting side surface 250, and the second closing driving surface 723 is in butt fit with the second over-travel leaf spring 23. It is obvious that such second elastic transmission structure does not comprise a structure of preventing the driving end 72 from sliding up and down.

The above-mentioned butt fit refers to a fit being both butted and separated, for instance, under a closing state, the second closing driving surface 723 is in butt joint to the second over-travel leaf spring 23, and the second disconnecting driving surface 722 may be separated from the second disconnecting side surface 250; and under a disconnecting state, the second disconnecting driving surface 722 is in butt joint to the second disconnecting side surface 250, and the second closing driving surface 723 may be separated from the second over-travel leaf spring 23.

According to the present invention, the base 3 is provided with the guide groove 30, the two guide transmission parts 6 and 7 are provided with guide ribs and contact guide devices, and when the two guide transmission parts moves leftwards and rightwards, any one of the transmission parts is limited from sliding downwards by means of fit between the contact guide device on the driven end of respective guide transmission part and the guide groove 30 on the base, and any one of the transmission parts is limited from sliding upwards by means of the guide device on the driving end of respective guide transmission part and the guide groove on the base, therefore, the two transmission parts 6 and 7 moves in the horizontal direction furthest to prevent desynchrony of two phases caused by deflection thereof, and therefore and shortening of the contact life. According to the present invention, the contact systems are placed at two sides of magnetic steel, such that the lever ratio of the contacts are increased, and therefore a larger contact pressure can be obtained on the premise that the power consumption of the coil of the product is lower, the action range of the product is expanded, the appearance size of the product is reduced, and therefore the product is more compact and attractive. Referring to FIGS. 1 and 3, a non-free end of the first movable flat spring 10 of the first contact device 1 is in U-shaped connection to a first movable connecting plate 11 respectively, namely the first free end 15 of the first movable flat spring 10 forms U-shaped configuration with the first movable connecting plate 11, and the first over-travel leaf spring 13 is a pressure leaf spring which participates in providing the final pressure of the final pressure for contacts; a non-free end of the second movable flat spring 20 of the second contact device 2 is in U-shaped connection to a second movable connecting plate 21 respectively, namely the second free end 25 of the second movable flat spring 20 forms U-shaped configuration with the second movable connecting plate 21, and the second over-travel leaf spring 23 is a pressure leaf spring which participates in providing the final pressure for contacts. The movable flat springs are in U-shaped connection with the connecting plates, such that a direction of an electrodynamic force borne by the movable flat spring is a direction away from the movable connecting plate so as to assist in increasing the contact pressure between the movable contacts and the static contacts, and the product can be reliably switched on under a high current by effectively utilizing the electrodynamic force to avoid the burning loss caused by bounce of the contacts. A pressure leaf spring is connected to the movable contact, and the final pressure of the contacts is mainly generated from the deformation of the pressure leaf spring. Pre-pressing over-travel is designed on the movable contacts and the static contacts, such that the pre-pressure is generated during contacting of the movable contacts and the static contacts, to ensure the working reliability of the relay. A plurality of structure solutions may be available for the first movable flat spring 10 of the first contact device 1 and the second movable flat spring 20 of the second contact device 2, wherein one preferred solution resides in that two groups of movable contacts and static contacts can be provided on each group of contacts respectively, namely referring to FIG. 12: two first movable contacts 17 are provided on the first movable flat spring 10, and correspondingly two first static contacts 16 re provided on the first static connecting plate; and two second movable contacts 27 are provided on the second movable flat spring 20, and correspondingly two second static contacts 26 are provided on the second static connecting plate, such that the contact surface is increased, the contact resistance and the temperature rise of the contacts are reduced, and the contact resistance reaches below 0.3 mΩ. The above-mentioned embodiments are just recommended embodiments of the present invention, and all the technical equivalent variations and modifications made in accordance to claims of the present invention should be considered to fall into the scope of the present invention.

The invention claimed is:

1. A bipolar magnetic latching relay, comprising a coil assembly mounted inside a cavity formed by engaging a shell cover and a base, a magnetic steel assembly that contains a permanent magnet and armatures, and a first contact device and a second contact device that are mounted at both sides of the base, wherein the magnetic steel assembly is pivotally connected with the base through a revolving pair, the magnetic steel assembly swings between two positions under the driving of an electric signal of the coil assembly and is retained in one swing position due to the permanent magnetic force of the magnetic steel assembly, and the swing synchronously drives the first contact device and the second contact device to deflect, such that a first movable contact on a free end of a first movable flat spring of the first contact device and a first static contact flat spring are subjected to closed/disconnecting fit, and meanwhile a second movable contact of a free end of a second movable flat spring of the second contact device and a second static contact are subjected to closed/disconnecting fit, wherein:

the magnetic steel assembly is provided with a first driving head and a second driving head that rotate synchronously with the magnetic steel assembly, and both the first driving head and the second driving head extend to the outside from the same direction C of the magnetic steel assembly;

the bipolar magnetic latching relay further comprises a first guide transmission part and a second guide transmission part that connect the two contact devices and the magnetic steel assembly, a first guide mechanism by which the first guide transmission part moves along a swing direction of the free end of the first movable flat spring is provided between the first guide transmission part and the base, a driven end of the first guide transmission part is connected with the first driving head of the magnetic steel assembly through a first driving connection structure, a driving end of the first guide transmission part is coupled to the free end of the first movable flat spring of the first contact device through a first elastic transmission structure, and a second guide mechanism by which the second guide transmission part moves along a swing direction of the free end of the second movable flat spring is provided between the second guide transmission part and the base, the second driven end of the second guide transmission part is connected to the second driving head of the magnetic steel assembly through a second driving connection structure, and a driving end of the second guide transmission part is coupled to the free end of the second movable flat spring of the second contact device through a second elastic transmission structure, such that the first guide transmission part and the second guide transmission part are the same in movement direction and simultaneously act.

2. The bipolar magnetic latching relay according to claim 1, wherein:

the first guide mechanism comprises a guide groove provided on the base and a first sliding block provided on the first guide transmission part, the first sliding block is mounted in the sliding groove and is in sliding fit with the guide groove, and the guiding direction of the guide groove is parallel to the swing direction of the free end of the first movable flat spring; and the second guide mechanism comprises a guide groove provided on the base and a second sliding block provided on the second guide transmission part, the second sliding block is mounted in the guide groove and is in sliding fit with the guide groove, and the guiding direction of the guide groove is parallel to the swing direction of the free end of the second movable flat spring.

3. The bipolar magnetic latching relay according to claim 1, wherein:

the first elastic transmission structure comprises a first guide sliding surface, a first disconnecting driving surface and a first closing driving surface that are provided on the driving end of the first guide transmission part, and a first guide end surface, a first disconnecting side surface and a first over-travel leaf spring that are provided on the free end of the first movable flat spring, wherein the first guide sliding surface is in sliding fit with the first guide end surface, the first disconnecting driving surface is in butt fit with the first disconnecting side surface, and the first closing driving surface is in butt fit with the first over-travel leaf spring; and the second elastic transmission structure comprises a second guide sliding surface, a second disconnecting driving surface and a second closing driving surface that are provided on the driving end of the second guide transmission part, and a second guide end surface, a second disconnecting side surface and a second over-travel leaf spring that are provided on the free end of the second movable flat spring, wherein the second guide sliding surface is in sliding fit with the second guide end surface, the second disconnecting driving surface is in butt fit with the second disconnecting side surface, and the second closing driving surface is in butt fit with the second over-travel leaf spring.

4. The bipolar magnetic latching relay according to claim 1, wherein:

the first elastic transmission structure comprises a first guide sliding rib, a first disconnecting driving surface and a first closing driving surface that are provided on the driving end of the first guide transmission part, and a first guide lug provided on the base, as well as a first disconnecting side surface and a first over-travel leaf spring that are provided on the free end of the first movable flat spring, wherein the first guide sliding rib is in sliding fit with the first guide lug, the first disconnecting driving surface is in butt fit with the first disconnecting side surface, and the first closing driving surface is in butt fit with the first over-travel leaf spring; and the second elastic transmission structure comprises a second guide sliding rib, a second disconnecting driving surface and a second closing driving surface that are provided on the driving end of the second guide transmission part, and a second guide lug provided on the base, as well as a second disconnecting side surface and a second over-travel leaf spring that are provided on the free end of the second movable flat spring, wherein the second guide sliding rib is in sliding fit with the second guide lug, the second disconnecting driving surface is in butt fit with the second disconnecting side surface, and the second closing driving surface is in butt fit with the second over-travel leaf spring.

5. The bipolar magnetic latching relay according to claim 1, wherein:

the first elastic transmission structure comprises a first disconnecting driving surface and a first closing driving surface that are provided on the driving end of the first guide transmission part, as well as a first disconnecting side surface and a first over-travel leaf spring that are provided on the free end of the first movable flat spring, wherein the first disconnecting driving surface is in butt fit with the first disconnecting side surface, and the first closing driving surface is in butt fit with the first over-travel leaf spring; and the second elastic transmission structure comprises a second disconnecting driving surface and a second closing driving surface that are provided on the driving end of the second guide transmission part, as well as a second disconnecting side surface and a second over-travel leaf spring that are provided on the free end of the second movable flat spring, wherein the second disconnecting driving surface is in butt fit with the second disconnecting side surface, and the second closing driving surface is in butt fit with the second over-travel leaf spring.

6. The bipolar magnetic latching relay according to claim 1, wherein:

the first elastic transmission structure comprises a first guide sliding surface, a first disconnecting driving surface, a first closing driving surface and a first guide sliding rib that are provided on the driving end of the first guide transmission part, and a first guide end surface, a first disconnecting side surface and a first over-travel leaf spring that are provided on the free end of the first movable flat spring, and further comprises a first guide lug that is provided on the base, wherein the first guide sliding surface is in sliding fit with the first guide end surface, the first disconnecting driving surface is in butt fit with the first disconnecting side surface, the first closing driving surface is in butt fit with the first over-travel leaf spring, and the first guide sliding rib is in sliding fit with the first guide lug; and the second elastic transmission structure comprises a second guide sliding surface, a second disconnecting driving surface, a second closing driving surface and a second guide sliding rib that are provided on the driving end of the second guide transmission part, and a second guide end surface, a second disconnecting side surface and a second over-travel leaf spring that are provided on the free end of the second movable flat spring, and further comprises a second guide lug that is provided on the base, wherein the second guide sliding surface is in sliding fit with the second guide end surface, the second disconnecting driving surface is in butt fit with the second disconnecting side surface, the second closing driving surface is in butt fit with the second over-travel leaf spring, and the second guide sliding rib is in sliding fit with the second guide lug.

7. The bipolar magnetic latching relay according to claim 1, wherein:

the first driving connection structure comprises a first connecting hole provided in the driven end of the first guide transmission part and a spherical first driving head that is provided on the magnetic steel assembly, and the first driving head is mounted in the first connecting hole and is in contact fit with the first connecting hole; and the second driving connection structure comprises a second connecting hole provided in the driven end of the second guide transmission part and a spherical second driving head that is provided on the magnetic steel assembly, and the second driving head is mounted in the second connecting hole and is in contact fit with the second connecting hole.

8. The bipolar magnetic latching relay according to claim 1, wherein: the revolving pair comprises a pivot provided on the magnetic steel assembly, a first pivot hole formed in the base and a positioning part provided with a second pivot hole, both ends of the pivot are mounted in the first pivot hole and the second pivot hole respectively in a pivot fit manner, and the positioning part is fixedly mounted in the base.

9. The bipolar magnetic latching relay according to claim 1, wherein: the revolving pair comprises a pivot provided on the magnetic steel assembly, a first pivot hole formed in the base and a second pivot hole formed in a shell cover, both ends of the pivot are mounted in the first pivot hole and the second pivot hole respectively in a pivot fit manner, and the shell cover is fixedly connected with the base.

10. The bipolar magnetic latching relay according to claim 3, wherein:

a non-free end of the first movable flat spring of the first contact device is U-shaped connection with a first movable connecting plate, and the non-free end of the second movable flat spring of the second contact device is in U-shaped connection with a second movable connecting plate;

the first over-travel leaf spring and the second over-travel leaf spring are pressure leaf springs that are participate in providing final pressure for contacts; and two first movable contacts are provided on the first movable flat spring, two first static contacts are also provided on a first static connecting plate, two second movable contacts are provided on the second movable flat spring, and two second static contacts are also provided on a second static connecting plate.

* * * * *